United States Patent [19]

Stern

[11] 3,930,273

[45] Jan. 6, 1976

[54] BED SAFETY SIDE RAIL ARRANGEMENT

[75] Inventor: Robert C. Stern, St. Louis, Mo.

[73] Assignee: Affiliated Hospital Products, Inc., St. Louis, Mo.

[22] Filed: Jan. 10, 1975

[21] Appl. No.: 540,240

Related U.S. Application Data

[63] Continuation of Ser. No. 393,191, Aug. 30, 1973, which is a continuation of Ser. No. 177,390, Sept. 2, 1971, abandoned.

[52] U.S. Cl. ..... 5/331; 5/100

[51] Int. Cl.[2] ..... A47D 7/02; A47C 21/00

[58] Field of Search ..... 5/331, 332, 100

[56] References Cited

UNITED STATES PATENTS

| | | | |
|---|---|---|---|
| 1,240,201 | 9/1917 | Haskes | 5/331 |
| 2,817,855 | 12/1957 | Pratt | 5/331 |
| 3,093,839 | 6/1963 | Higgins | 5/331 |
| 3,125,769 | 3/1964 | Black et al. | 5/331 |
| 3,175,453 | 3/1965 | Williams | 85/8.3 |
| 3,233,930 | 2/1966 | Becker | 85/8.8 |
| 3,419,922 | 1/1969 | Malherbe | 5/331 |
| 3,585,659 | 6/1971 | Burst et al. | 5/331 |

*Primary Examiner*—Paul R. Gilliam
*Assistant Examiner*—Andrew M. Calvert
*Attorney, Agent, or Firm*—Reginald F. Pippin, Jr.

[57] ABSTRACT

A bed safety side rail arrangement which includes two opposite articulated side rail assemblies selectively pivotally movable from an upper safety position to a lowered position, as for patient transfer and handling and/or bedmaking tasks. The opposite side rail assemblies are readily removably secured to opposite sides of a bed, and desired structural rigidity is provided through the medium of tubular cross members or cross member assemblies which engage the side rail assemblies at their respective pivot connections.

24 Claims, 14 Drawing Figures

FIG. 1
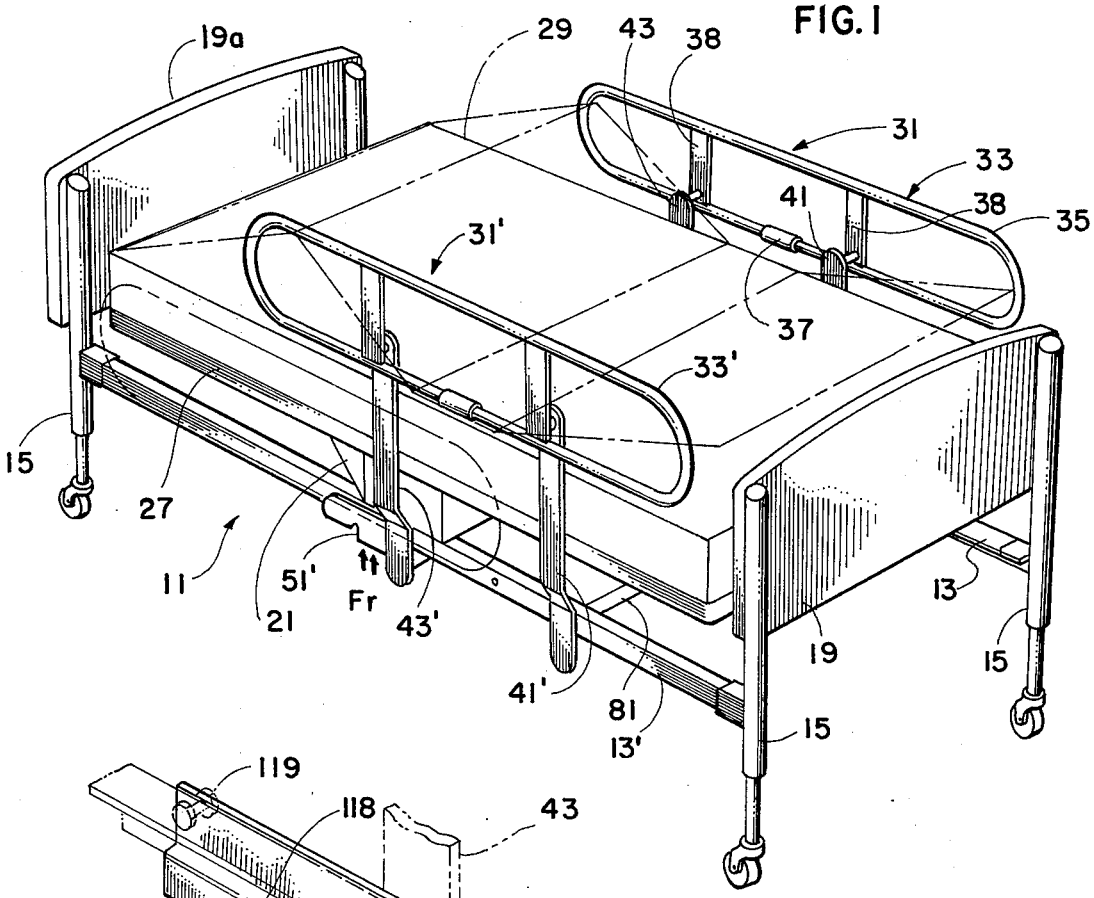
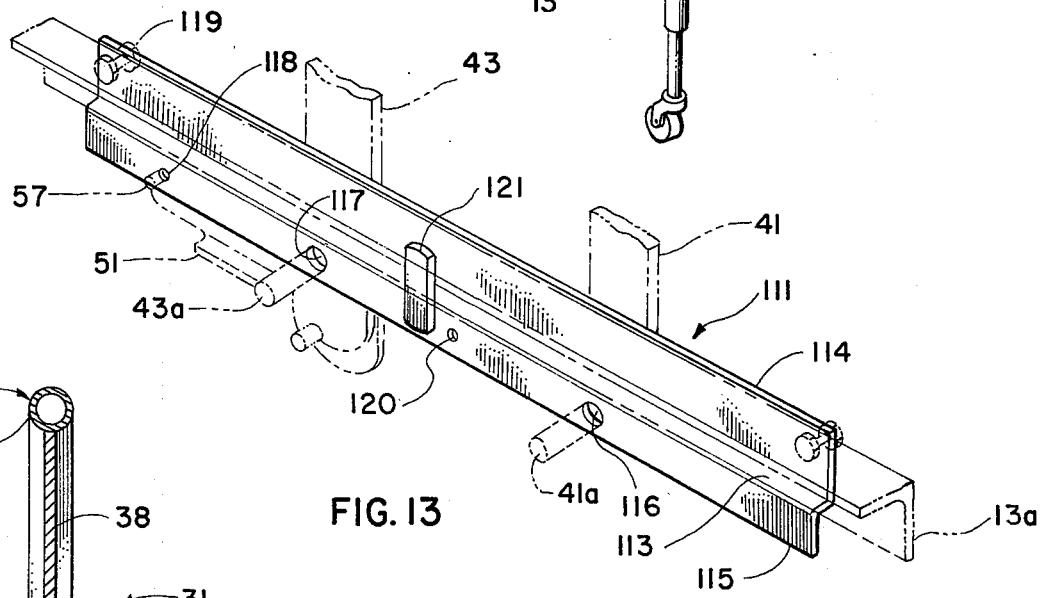
FIG. 13
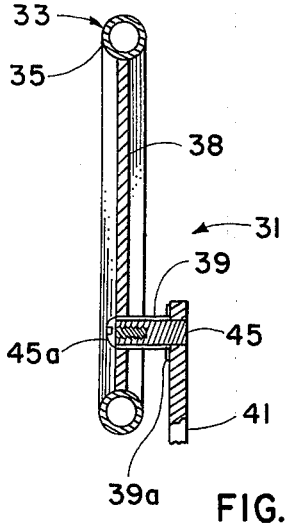
FIG. 14
ROBERT G. STERN
INVENTOR
BY
ATTORNEY

ROBERT G. STERN
INVENTOR

BY

ATTORNEY

ROBERT G. STERN
INVENTOR

BY

ATTORNEY

ROBERT G. STERN
INVENTOR

ATTORNEY

ROBERT G. STERN
INVENTOR

ATTORNEY

ROBERT G STERN
INVENTOR

BY Reginald A. Piff Jr.
ATTORNEY

ROBERT G. STERN
INVENTOR

BY

ATTORNEY

BED SAFETY SIDE RAIL ARRANGEMENT

This is a continuation of application Ser. No. 393,191, filed Aug. 30, 1973, which in turn is a continuation of Ser. No. 177,390, filed Sept. 2, 1971, now abandoned.

This invention relates to bed safety side rail arrangements and to beds incorporating such arrangements, and more particularly to self-rigidified articulated bed side rail and support assemblies which may be easily installed and removed.

Various safety side rail arrangements have been made in the past, including various articulated arrangements; however, such side rail arrangements have had various shortcomings. Included in these shortcomings are the utilization of additional supporting or rigidifying members which are welded or bolted to the bed frame. Such welded or bolted members on the bed frame usually provide pivot points for the rail assembly, as well as a means for fastening the rail assembly to the bed, and serve to transfer undesirable bending loads to the bed frame, as well as sometimes providing less side rail lateral stability than is desirable. In addition, in various ones of the prior art constructions a latch is located in the upper portion of the rail, which is generally undesirable inasmuch as it allows the patient to purposely or inadvertently to disengage the latch and lower the side rail from its safety position.

It is an object and feature of the present invention to provide a safety side rail arrangement which enables the provision of side rails on a bed without requiring additional reinforcing members or mechanisms permanently or otherwise rigidly secured to the bed frame in order to support and rigidify the side rail.

It is a further feature of the invention to provide a detachable side rail assembly which does not require the utilization of ancillary securing hardware such as nuts, bolts, cotter pins, or the like for installation on a bed.

Still a further feature of the invention is to provide a bed safety side rail arrangement which may be installed and removed manually and without tools, and which may be easily installed and removed by a novice without any assistance from a second party.

A further feature of the invention is the provision of a side rail arrangement having a latch which engages automatically when the side rail is raised, and which may be easily released by authorized personnel standing to the side of the bed, while according substantial difficulty and impediment to release by a person, such as a bedridden patient, lying on the bed.

Still a further feature of the invention is to provide a side rail arrangement which may be utilized on a variety of bed models, including beds of older construction, and with a minimum of adaptation required.

Still other objects, features and attendant advantages will become apparent to one skilled in the art from a reading of the following detailed description on several physical embodiments constructed in accordance with the invention, taken in conjunction with the accompanying drawings wherein:

FIG. 1 is a perspective view of a bed arrangement incorporating the invention.

FIG. 13 is a fragmentary perspective view of a modification, illustrating an adapter arrangement for enabling ready attachment of the side rail assembly to a bed frame not otherwise particularly adapted for the illustrated side rail assembly of FIG. 1.

FIG. 14 is a sectional view taken on the line 14—14 of FIG. 2.

Figure 2:
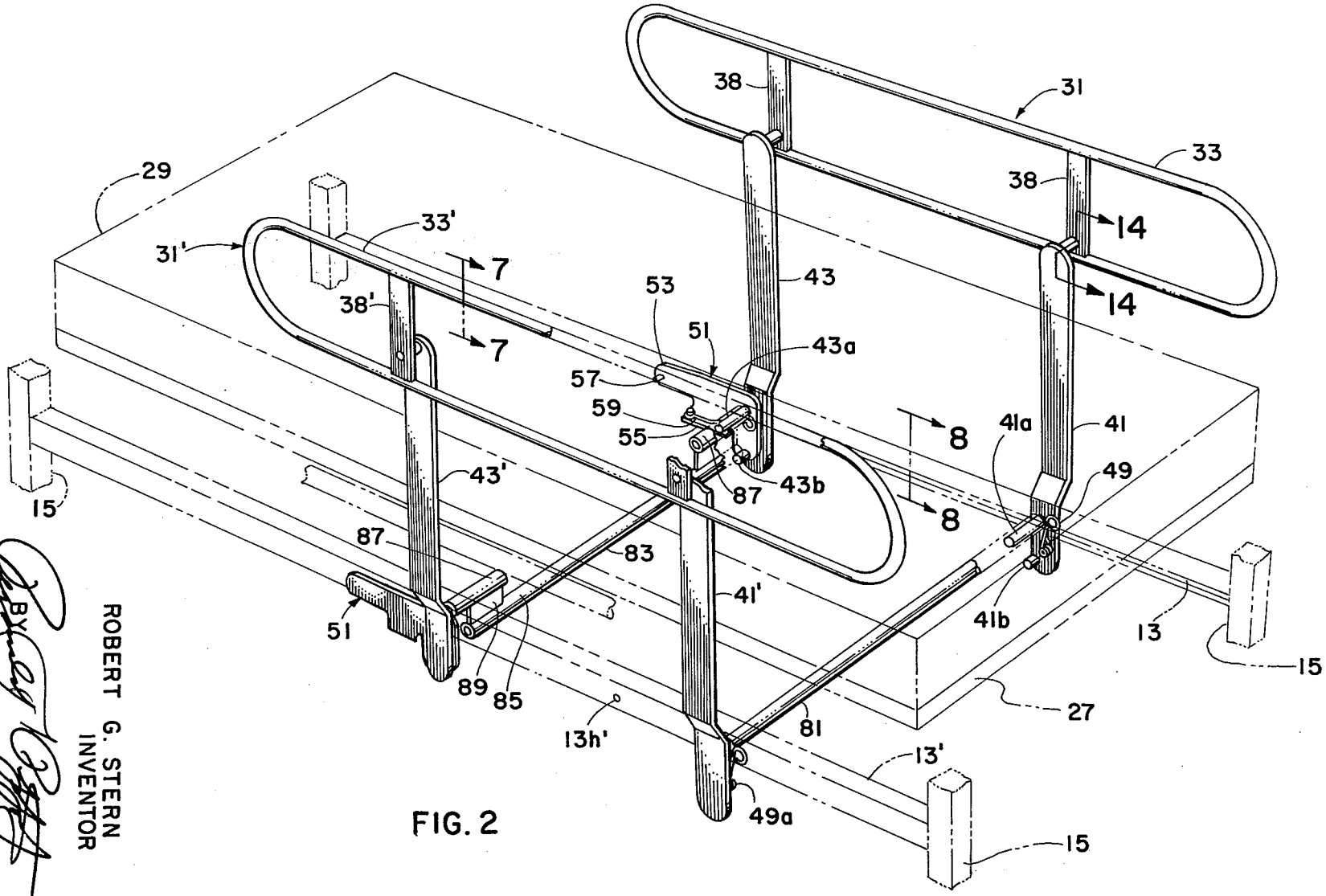
FIG. 2 is a schematic representation illustrating the side rail arrangement of FIG. 1, with the bed frame and mattress schematically illustrated in phantom for clarity of illustration.
Figure 3:
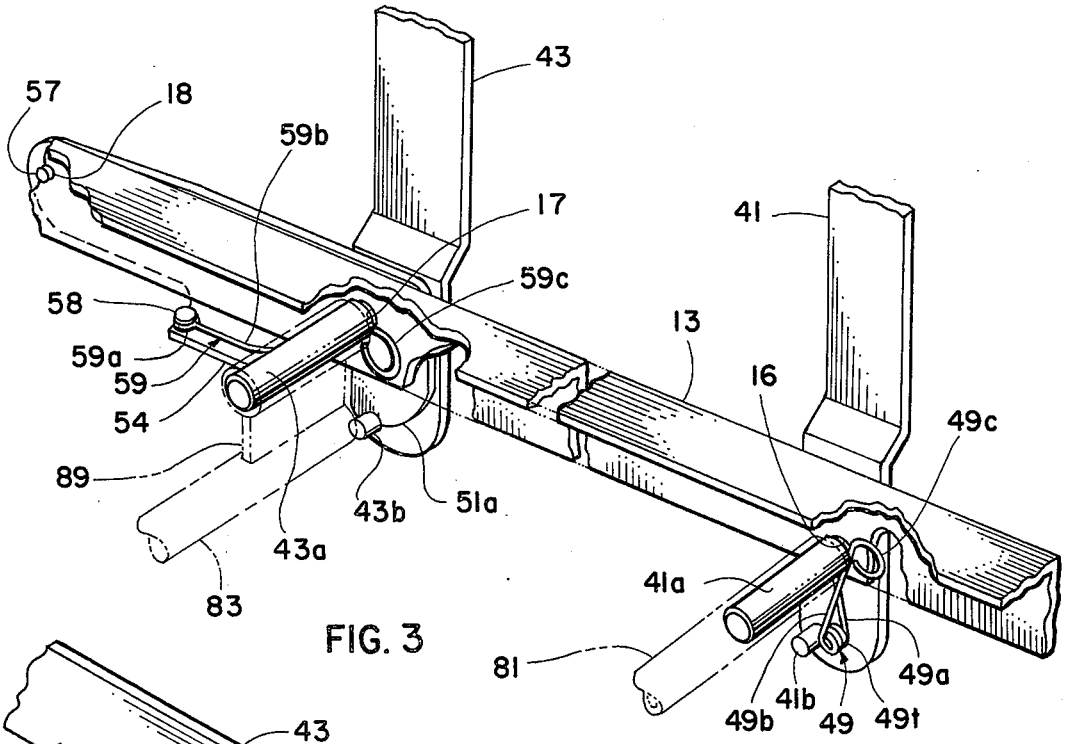
FIG. 3 is a fragmentary view of the zone of connection of one of the side rail assemblies with the bed frame, with the side rail assembly in the upper safety position.
Figure 4:
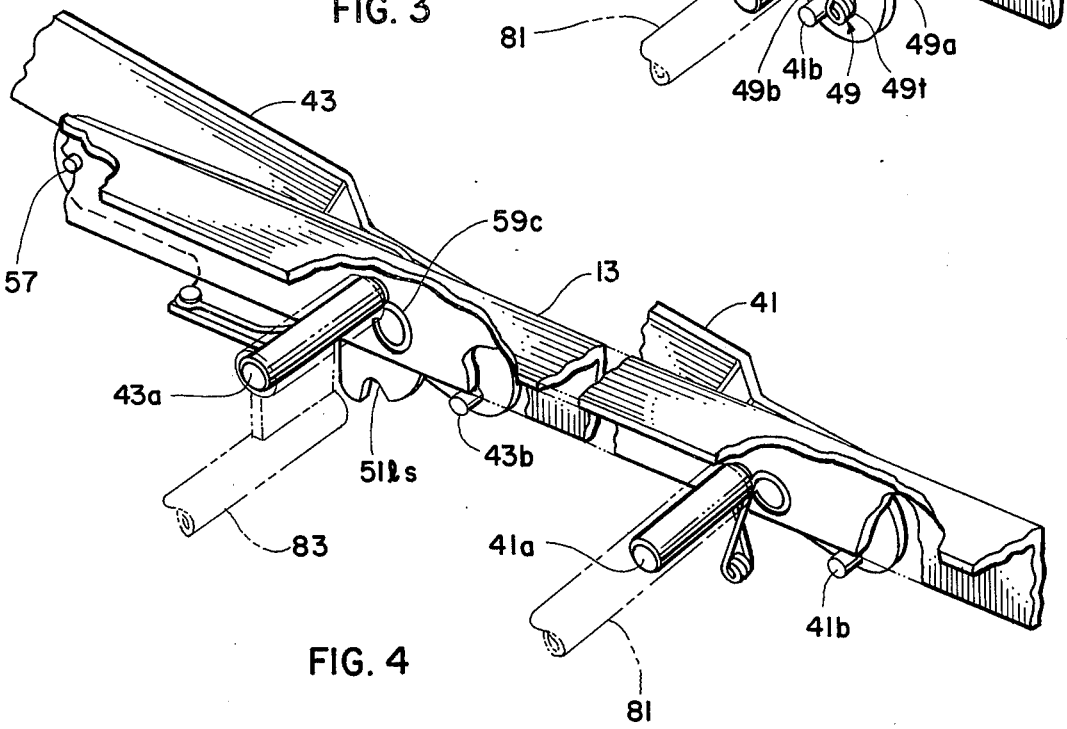
FIG. 4 is a fragmentary view similar to FIG. 3, with the side rail assembly in a pivotally lowered stop position.

Referring now in detail to the Figures of the drawing, in the illustrative embodiment of FIG. 1, a bed generally indicated at 11 has provided thereon two side rail assemblies 31, 31', the side rail assemblies being shown in the raised safety position, with their respective side rails 33, 33' extending above the mattress 29, which may be supported in any conventional and suitable fashion, as by a spring frame 27 which may be in turn supported on a suitable support assembly which may be either rigid or provided for conventional articulated movement of the spring frame 27. In the illustrated assembly, a conventional central support assembly 21 is schematically illustrated, which is secured to longitudinal side frame members 13, 13', and additional or other spring frame supporting members may be suitably provided as may be desired or necessary, as well as articulation effecting mechanism or mechanisms, as is conventional in the bed art, and particularly the hospital patient care bed art. The side frame members 13, 13' are conventionally secured to support legs 15, with a headboard 19 and footboard 19*a* provided thereon. A typical articulated position of the mattress 29 is illustrated in phantom in FIG. 1, to illustrate the utility of the side rail assemblies for various positions of the spring frame and mattress in this or various other bed assemblies on which the side rail arrangement may be suitably employed.

The side rail assemblies 31, 31′ are preferentially mirror images of one another, and the various corresponding parts of the side rail assembly 31′ are accordingly designated by the same numbers as used for the side rail assembly 31, with the addition of a prime (′) reference mark thereto. The invention will therefore be described in detail with respect to only one side rail assembly 31, it being understood that the opposite side rail assembly 31′ is preferably identical mirror image.

The two side rail assemblies 31 and 31′ include risers 41, 43 and 41′, 43′ respectively, which are releasably pivotally secured to the side frame members 13 and 13′ of bed 11. The securement of the risers 41, 43 and 41′, 43′ is facilely effected by a single operator without the necessity for the use of tools. The mode of interconnection and mounting of the risers is best illustrated in FIGS. 2–9.

Referring now to the side rail assembly 31, the risers 41 and 43 are each provided with pivot pins or shafts 41*a*, 43*a*, which engage within corresponding slightly oversize openings 16 and 17 formed in the relatively thin vertical wall of the longitudinal side frame member 13, which member may suitably be a rigid angle iron member such as is provided in conventional bed construction. Side rail assembly 31′ is likewise provided with corresponding riser pivot pins which extend into similarly spaced corresponding mounting holes in the longitudinal side frame member 13′. The risers rely for vertical support upon the bed side frame members 13, 13′, but do not utilize these bed side frame members for rigidity against lateral bending moments which may be exerted on the side rail assemblies, as by a patient moving against the side rail. The two side rail assemblies are rigidified and bending moments are taken by two cross tube arrangements, 81, 83, the head end cross tube arrangement being a simple open tube which engages at its opposite ends with the inwardly extending pivot pin 41*a* on the riser 41 and the pivot pin, not shown, on the riser 41′. The foot end cross tube assembly 83 may in various bed arrangements be a simple tube such as 81, but for more universal use, as where bed operating mechanisms pass along the bed frame in this zone, an offset cross tube assembly is provided, including an offset cross tube 85 which is secured at its opposite ends to two end tubes 87 through the medium of a spacer web 89, the end of the cross tubes being in complementary pivot-engaging relation with the riser pivot pin 43*a* of riser 43 and the corresponding opposing riser pivot pin, not shown, of riser 43′.

The cross tube 81 and cross tube assembly 83 provide the side rail assemblies with a suitable rigidifying support structure without necessitating transfer of bending moments into the bed frame, which transfer of bending moments to the bed frame is typical of cross members which are welded or otherwise rigidly fastened to the bed frame. It will be appreciated that the cross tubes act on the riser pivot pins in this respect, so as to substantially minimize lateral bending movement of the side rail assemblies.

Referring in particular to FIGS. 3 and 5–8, each of the risers 41 and 43 is provided with a retainer spring 49, 59, respectively, which serves to removably secure the risers 41 and 43 to the side frame member 13. The retainer spring 49 takes the form of a dual leg torsion-acting spring arrangement having a torsion coil 49*t* with extending spring mounting leg 49*b* and spring retention leg 49*a*. Formed on the end of the spring mounting leg 49*b* is a mounting wrap 49*w* which engages in rotatably slidable wrapsecuring relation about the riser pivot pin 49*a* at a position adjacent the riser 41. As will be seen in FIG. 6, spring 49 is held in place adjacent the zone of interconnection of the riser pivot pin or shaft 41*a* with the riser lower end 41-1, through the medium of washer 67 and snap retainer ring 65, the retainer ring 65 being of conventional construction and engaging within a narrow annular retaining groove 41*af* in the riser pivot pin. Thus, washer 67 and spring mounting wrap 49*w* are for sliding rotational or arcuate movement on the riser pivot pin 41*a*, retained between snap ring 65 and the inner face of riser 41. The spring retention leg 49*a* engages in an annular retaining groove 49*ag* formed in the riser pivot pin at a position spaced axially from the zone of engagement of the mounting wrap 49*w*, and the end of the spring retention leg 49*a* is provided with a finger grip loop 49*c* which enables the release of the spring retention leg 49*a* from the groove 49*ag* in order to effect assembly and removal of the riser 41 with respect to side frame member 13. Thus, in mounting the riser 41 on the bed, the riser pivot pin 41*a* is inserted into the hole 16 in the frame member 13, and the finger grip loop 49*c* is pulled downwardly into a position beneath the lower edge of the side frame member 13 and is then released on the inner face side of the side frame member 13 and replaced into the retaining groove 41*ag*, thereby securely positioning the riser 41 and pivot pin 41*a* in pivotal position on the side frame member 13. Removal of the riser 41 may be readily accomplished by reversal of this operation.

Mounting of the riser 43 on the frame side member 13 is accomplished in a generally similar but slightly modified fashion, the riser 43 having a differently constructed retainer spring 59 which is associated with a latch 51 which serves to releasably lock the riser 43 in the raised safety position for the side rail assembly 31. It will be appreciated that locking of the riser 43 in this position will likewise lock riser 41 in position in view of the parallelogram arrangement of these risers 41, 43, in conjunction with side frame member 13 and side rail 33.

Figure 5:
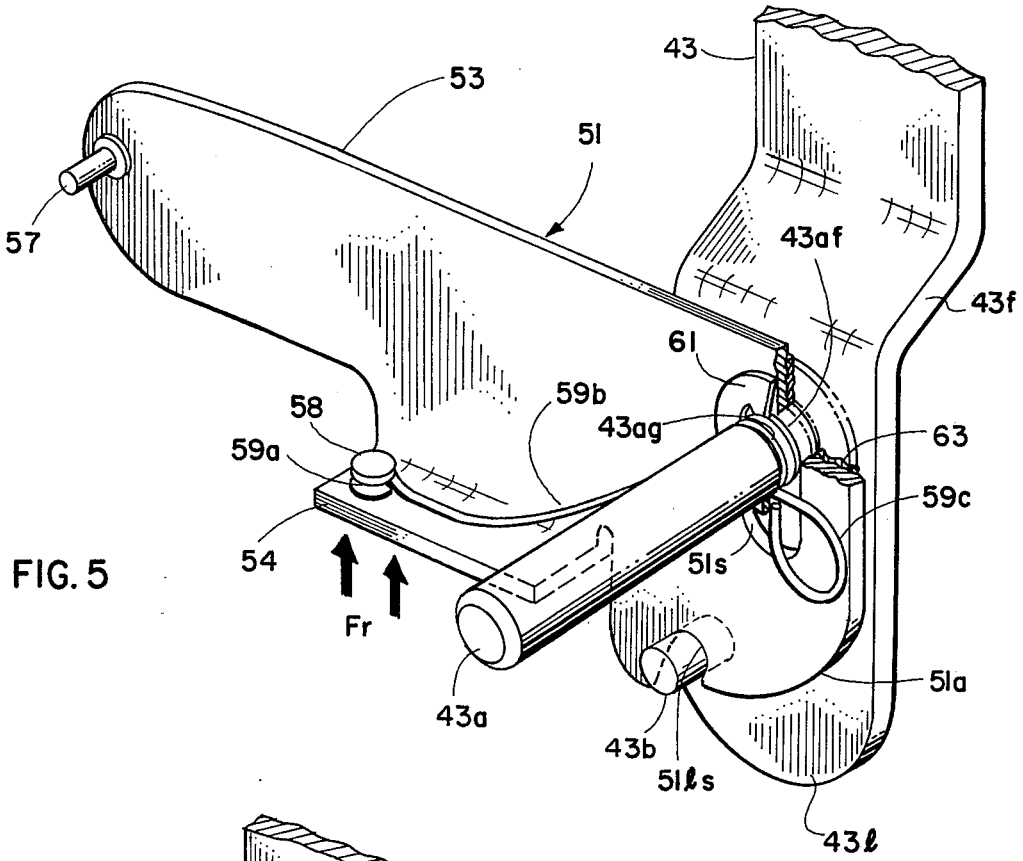
FIG. 5 is a fragmentary view of the bed attachment end of the foot end or latch-connected riser of one of the side rail assemblies.
Figure 6:
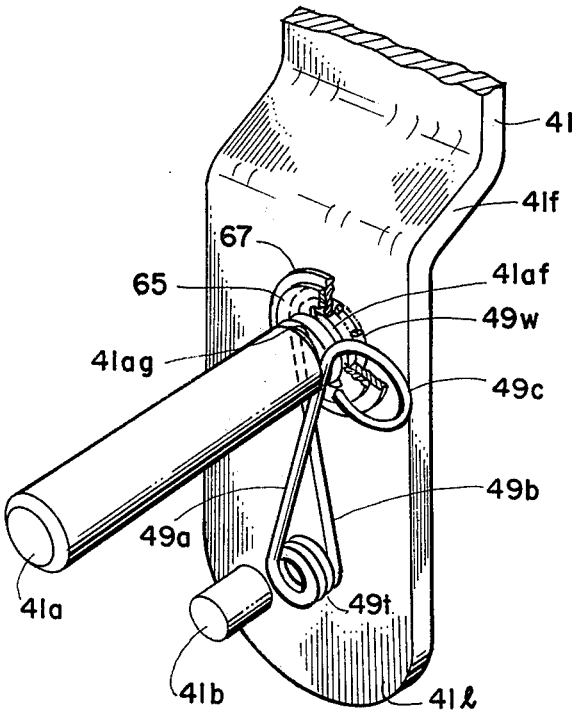
FIG. 6 is a fragmentary view of the bed attachment end of the head-end riser of one of the side rail assemblies.
Figure 7:
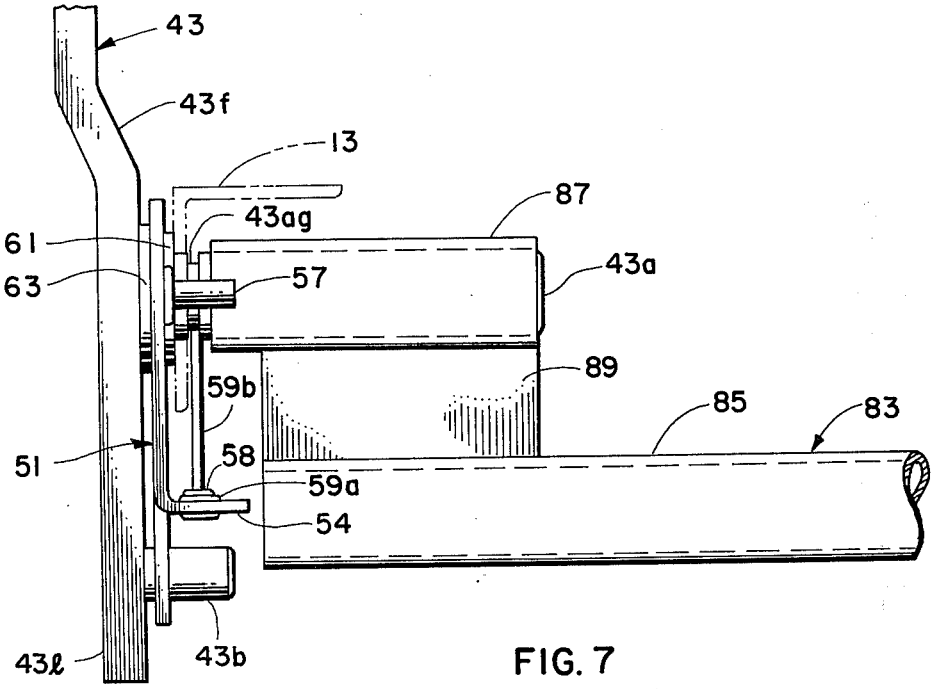
FIG. 7 is a fragmentary view taken on the line 7—7 of FIG. 2.

The latch 51 and its assembly with foot end riser 43 is best seen in FIGS. 5 and 7. Latch 51 has a vertically extending slot 51*s* to accommodate relative vertical movement between the latch and riser pivot pin 43*a*, to enable locking and release action of the latch with respect to lock stop pin 43*b*, which is suitably secured on the lower end portion of the riser lower end 43-l. Riser pivot pin or shaft 43*a* extends through slot 51*s*, and the latch 51 is secured to the riser 43 through the medium of a snap retainer ring groove 43*af* formed in the periphery of the riser pivot pin 43*a*. A flat washer 63 is slidably mounted on the pivot shaft or pin 43*a* between the outer face of latch 51 and the inner face of riser 43.

Latch 51 has a lock slot 51-*la* formed thereon for engagement with the lock/stop pin 43*b*, to afford locking of the riser 43 in the raised safety position for the side rail assembly 31. The latch is provided with a latch pivot pin 57 which is suitably secured, as by welding, at the opposite end zone of a bent-in section 53, and in the engaged position of the pivot pin 57 with the side frame member 13 the latch 51 is enabled to pivot about the axis of pivot pin 57 and thereby afford vertical motion of the latch relative to the riser 43 and riser pivot pin 43*a*, within the limits of restriction of the slot 51*s*, thus enabling engagement and disengagement of the lock/stop pin 43*b* with the lock slot 51-*ls*, as may be desired. As an aid to the engagement of the lock stop pin 43*b* with the lock slot 51-*ls*, a latch cam surface 51*a* is formed on the latch 51 adjacent the lock slot 51-*ls*, whereby the latch 51 is cammed upwardly by the engagement of the lock stop pin in the course of raising the foot end riser 43, with the lock stop 43*b* thereupon reaching the lock slot 51-*ls*, at which time the latch 51 will pivot downwardly and engage the lock stop pin 43*b* in the lock slot 51-*ls* under the influence of gravity and the resilient spring action of spring 59 which serves the dual purpose affording this resilient biasing action and retaining the riser 43 and latch 51 in engagement with the bed frame, namely the side frame member 13.

Retainer spring 59 is a cantilever spring having an anchor end loop 59*a* anchored to a flange 54 on the latch 51, as through the medium of a headed anchor pin 58 riveted or otherwise suitably secured in place, the spring 59 having an upwardly curved cantilever medial 59*b*, with a finger grip loop 59*c* at its free end, the medial and/or end zone adjoining loop 59*c* engaging with an annular retaining groove 43*ag* formed in the riser pivot pin 43*a* at an axial position spaced from snap-retainer ring 61 by a distance sufficient to accommodate the vertical side web of the side frame member 13 through which the riser pivot pin 43 extends at the zone of connection with hole 17 therefor.

Flange 54 serves the dual function of serving as a cantilever mount for retainer spring 59 and also providing an advantageously disposed and formed hand-engaging surface for exerting an upward latch release force $F_r$, as indicated generally by the dual arrows in FIGS. 1 and 5.

In securing the riser 43 and associated latch 51 to the frame side member 13, the riser pivot pin or shaft 43*a* is inserted into slightly oversized complementary mounting hole 17 formed in the relatively thin-walled vertical web position of side frame member 13, and a latch pivot pin 57 is inserted into slightly oversized complementary hole 18, likewise formed in side frame member 13. Finger grip loop 59*c* is utilized to bend the spring 59 downwardly to a position beneath the lower surface of side frame member 13, permitting the riser pivot pin to be fully inserted into the mounting hole 17, whereupon the spring 59 is replaced in the annular retaining groove 43*ag* on the inner face side of the side frame member 13 through which the pin 43*a* extends. Sufficient clearance is provided between the flange 54 and the lower edge side frame member 13 to enable upward pivot release action of the latch 51 about the axis of pivot pin 57 in its respective frame mounting hole 18. As noted above, the foot end 53 of the latch 51 is bent laterally inwardly at a small angle relative to the head end section of the latch, the bend being suitably effected in the zone adjacent the anchor pin end of flange 54. This inward bending of the section 53 of latch 51 enables self-retention of the latch pivot pin in mounting hole 18 without the necessity of a keeper on the latch pivot pin, it being appreciated that the riser pivot pin 43*a* is held against an undesirable degree of canting motion through its engagement with its associated cross tube assembly 83, as shown particularly in FIGS. 2–4 and 7.

Removal of the foot end riser 43 and associated latch 51 carried thereby is readily accomplished by reversal of the assembly operations discussed above, such essentially only requiring manual downward bending of the spring 59 while the foot and riser 43 is pulled outwardly to thereby remove the riser pivot pin 43*a* and latch pivot pin 57 from engagement with the side frame member 13.

As shown particularly in FIGS. 1, 2 and 14, the side rails 33 take the form of a length of tubing, preferably steel, formed in a loop 35 with both ends secured together through the medium of a short tubular coupling 37, as by sweat soldering or other suitable connecting medium. Two spreader bars 38 are suitably secured between the upper and lower parallel runs of loop 35, as by soldering, in order to provide a desired rigidity to the side rail tube assembly, and also serve to facilitate pivotal mounting of the risers 41 and 43 to the side rail 33. To this end, as shown in FIG. 14, a tube spacer 39 is suitably secured, as by soldering, to each spreader bar 38, preferably in a vertically off-center position, and a pivot pin 45 is suitably secured, as by welding, in the top end of the risers 41 and 43, the pivot pin 45 extending in pivotal relation within the tube spacer 39 and being pivotally secured in place as through the medium of a headed screw 45*a* which engages within a threaded bore in the pivot pin 45, and the head of screw 45*a* extending beyond the inner diameter of tube spacer 39 to effect suitable retaining action. A spring washer 39*a* is disposed between the tube spacer 39 and the adjacent face of riser 41 to aid in prevention of looseness or vibration between these parts. The length of tube spacer 39 is sufficient to provide lateral stability for the side rail 33 and also to minimize the pinching hazard for fingers and electrical cords which may be created by the scissor action of the risers and side rail 33 during raising and lowering.

Figure 8:
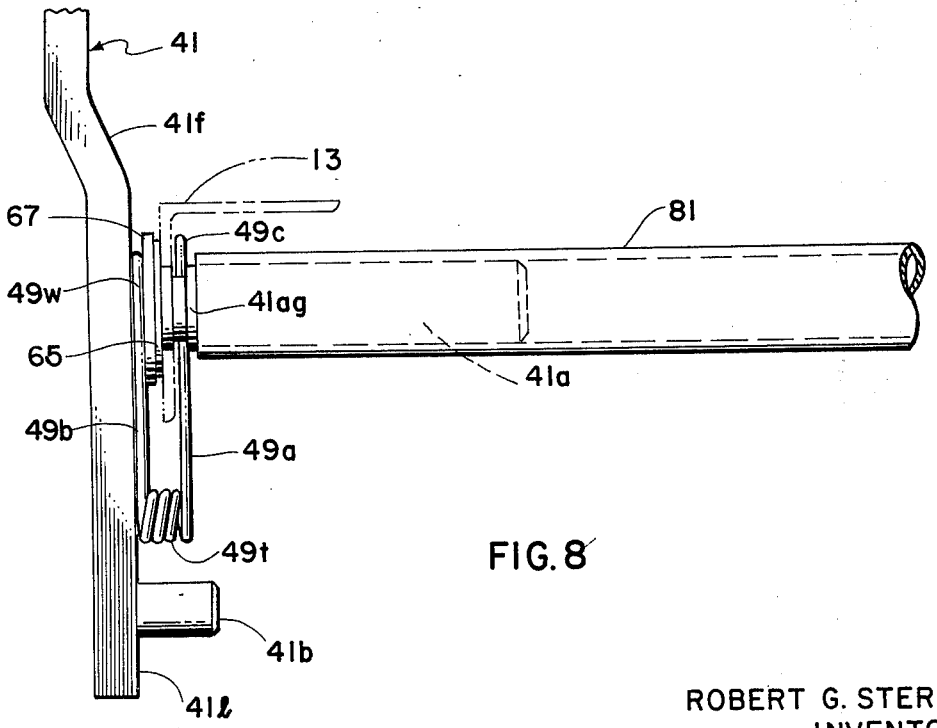
FIG. 8 is a fragmentary view taken on the line 8—8 of FIG. 2.
Figure 9:
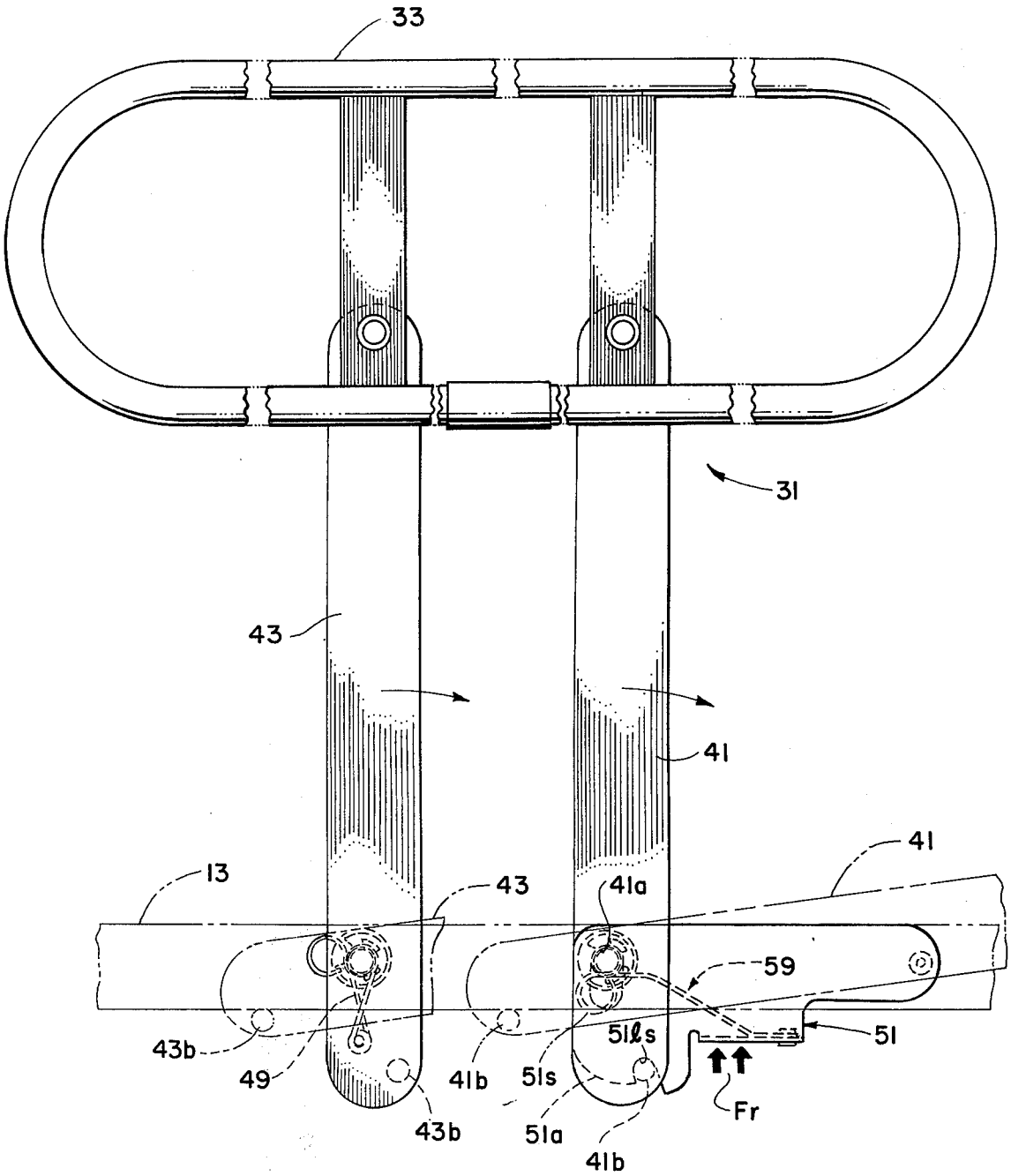
FIG. 9 is a side elevation view of one of the side rail assemblies, illustrating the position of the side rail in full lines in the safety position, and showing the lowered position of the side rail risers in phantom line, the bed frame connecting member being illustrated in phantom for clarity of illustration.

It will be noted that the risers 41, 43 are constructed of substantially rigid flat material, preferably from a flat steel bar. An offset 41*f*, 43*f*, is formed in the risers 41, 43, as illustrated in FIGS. 7 and 8, and provides sufficient clearance between the various moving parts, such also aiding in reducing the pinching hazard which is inherent in articulated side rail assemblies. Although the riser bars are relatively rigid, there is enough springiness available to absorb a large portion of the lateral loads without making the assembly flimsy and noisy in operation.

In mounting of the side rail assembly, 31, 31′ and associated cross members 81, 83, onto bed 11, one of the side rail assemblies is first removably secured to its respective side frame member, as has been described above, with the riser 41, riser 43 and associated latch 51, retained in their respective mounting holes 16, 17, 18 through the medium of retainer springs 49, 59. Thereupon, the cross tubes 81, 83 are brought into end engagement with their respective riser pivot pins or stub shafts, and the opposite side rail assembly is then positioned with its pivot mounting pins or stub shafts in the corresponding respective three holes in the other side frame member, the corresponding open ends of the cross tube members 81, 83 being held in alignment with the pivot pin holes for the respective riser pivot pins during mounting of this opposite side rail assembly with its respective risers onto the respective opposite side frame member. The second side rail assembly is then similarly releasably retained in place by manual manipulation of the retention springs 49, 59 associated with the respective riser pivot pins, whereupon the bed and side rail assembly is in condition for utilization.

Lowering of either or both of the side rails 33 or 33′ may be selectively effected by manually exerting a small upward hand or foot force $F_r$ on the underside of the in-turned release flange on the respective latch 51 or 51', to thereby release the lock/stop pin 43*b* or 43*b'* (not shown) from the respective lock slot in latch 51, while exerting a force on the respective side rail toward the foot end of the bed, to thereby move the lock/stop pin out of the lock slot on the latch, and permit the side rail assembly to be articulated in a scissors parallelogram motion to its lowered position, at which position the respective riser stop pins 41b and 43b, or 41*b'*, 43*b'* (not shown) engage the undersurface of the respective side frame member 13 or 13', to effect a lowered stop position for the side rail. Raising of the side rail assembly merely requires the operator to grasp the side rail 33 or 33' and exert an upward pull thereon, which will result in the reverse scissors parallelogram motion of the risers and associated side rail, to bring the respective lock/stop pin 43*b* or 43*b'* (not shown) into engagement with its respective latch cam surface 51a or 51*a'* (not shown) and latch lock slot 51-*ls* or 51-*ls'* (not shown).

Figure 10:
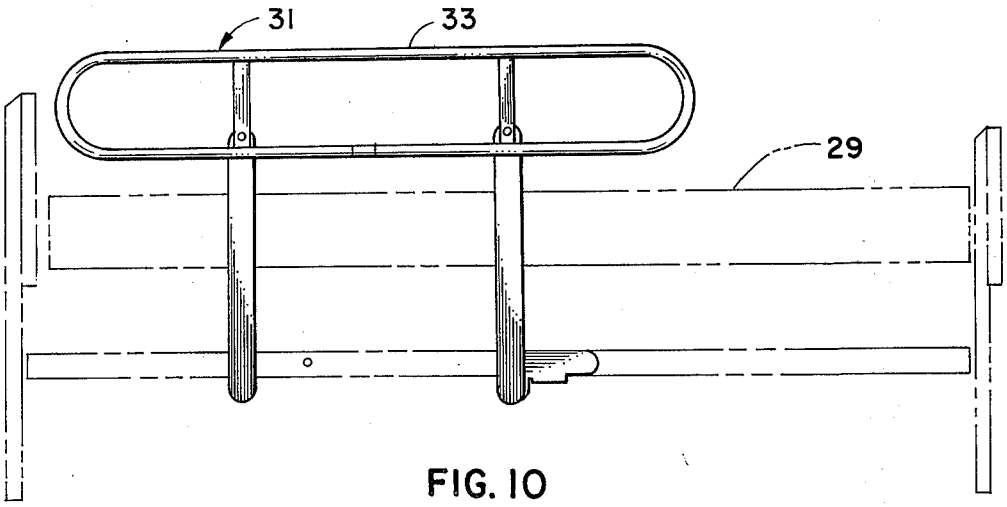
FIGS. 10 and 11 are schematic representations of the bed arrangement of FIG. 1, showing respectively the relationship of the side rail assembly with the major bed parts, in respectively the raised safety position and the lowered position.
Figure 11:
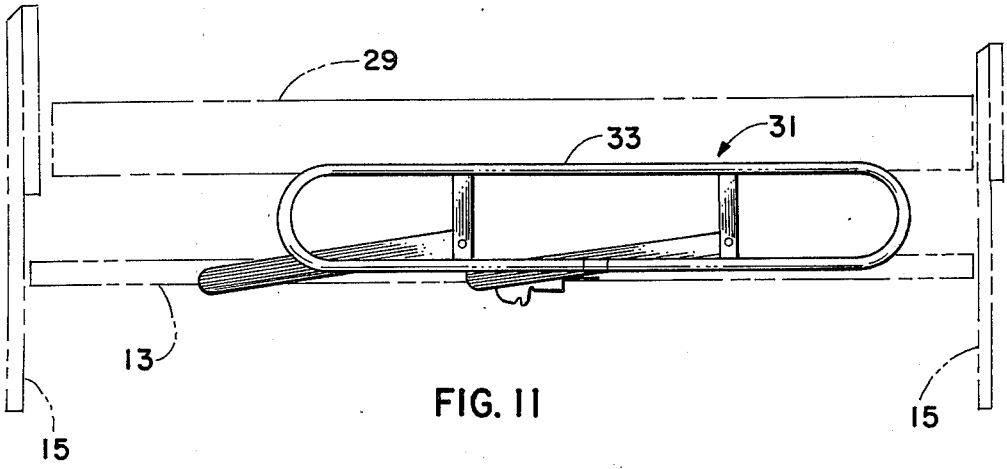

FIGS. 10 and 11 illustrate the relative positions of the side rail assemblies, in the raised safety and lowered position respectively, with respect to the major bed components. It will be noted that when the side rail is in the lowered position almost all of the mattress is exposed in the illustrative embodiment, and the side rail does not materially interfere in the bed making task. Also, this positioning of the side rail assembly in the lowered position is of importance in preventing interference with the patient being placed onto or removed from, or personally getting in or out of, the bed.

Figure 12:
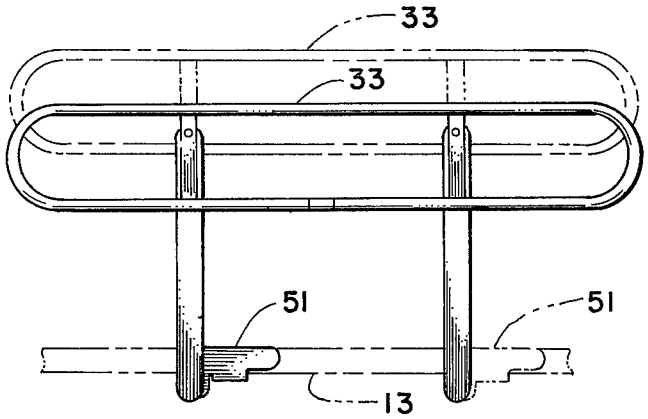
FIG. 12 is a schematic representation illustrating the inverted reversal of the side rail and riser arrangement to provide a different effective side rail height, this different height position being illustrated in full lines, and the position of the side rail, riser and latch as in FIG. 1 being shown in phantom line.

The side rail assembly according to the illustrated and preferred embodiment of the invention enables the side rail 33 or 33' to be located in its upper safety position at either of two heights relative to the mounting position of the risers on the bed frame member, as illustrated in FIG. 12. The location of the side rail 33 and latch 51 corresponding to the location in FIGS. 1–11 is illustrated in phantom lines, while the second location of the side rail and latch is illustrated in full lines.

As has been noted heretofore, the risers are preferably connected to the spreader bars 38 in a vertically offset position with respect to the vertical center of the spreader bars, as shown in FIG. 14, and it is only necessary to rotate the risers about their respective pivot pin connections with the side rail spreader bars through a 180° arc, and to thereupon rotationally translate the entire side rail assembly through a further 180° arc, to effect the desired effective vertical change of position of the side rail 33 or 33' relative to the riser pivot pins which connect with the frame. This reversal brings the respective latch 51, 51' from the foot end riser position to the head end riser position, likewise reversing the risers themselves. Thus, by providing an extra hole for mounting the latch pin therein adjacent the head end hole 16, the two risers and latch may be suitably mounted on the bed frame with the respective side rail 33, 33' at a different vertical height position in the raised safety position thereof. This positioning of the latch 51, 51' in the head end riser position is not normally as desirable as its illustrated position at the foot end riser location, particularly in view of the ease of operation of the latch by an operator at the foot end riser position.

The foregoing described dual height capability for the side rail assembly in the raised safety position enables the side rail assembly to be utilized on beds having the upper mattress surface at different heights relative to the bed frame mounting members 13, 13', while providing generally similar relative side rail positioning with respect to the mattress upper and lower surfaces. It will be apparent that greater or less height difference may be accommodated by greater or less offset of the connection point for the risers to their respective side rail spreader bars.

If desired, the side rail assemblies may be mounted on a bed having no mounting hole positions formed therein corresponding to the required riser and latch pivot pins, either by forming such holes in the bed frame members, or by attaching an auxiliary adapter bar 111, to the desired bed frame member, as illustrated in FIG. 13. The adapter bar 111 takes the form of a longitudinal bar having a vertical offset between its upper and lower section 114, 115, the intermediate offset section 113 being of approximately the same effective width as the effective width of the vertical web portion of the side frame member 13a to which the adapter bar 111 is to be attached. Thus, the lower longitudinal section 115 is in generally vertical alignment with the vertical web portion of the angle bar side member 13*a* when attached thereto, while the upper longitudinal section 114 of the adapter bar 111 is positioned flush along the external face of the side frame member. The adapter bar may be suitably secured to the side frame member 13*a* as through the utilization of securing screws or bolts, as indicated at 119. This will require the presence or forming of relatively small holes in the side frame member 13*a* to accommodate the screws or bolts 119, which holes are present in various existing bed frames. However, even is such holes must be subsequently formed in the bed frame, they may be more readily, and possibly more acceptably, formed than the more precisely and differently sized holes required for mounting of the riser pivot pins and latch pins of the two side rail assemblies. The auxiliary mounting adapter 111 has formed in its lower longitudinal extent mounting holes 116, 117 and 118 corresponding respectively to the positioning of holes 16, 17 and 18 for respective riser pivot pins 41*a*, 43*a* and latch pivot pin 57. An extra latch pivot pin hole 120 may be provided adjacent the hole 116 to accommodate the latch pivot pin 57 in the side rail reversal position as illustrated in FIG. 12. The adapter bar 111 also has a keeper 121 secured to its lower longitudinal section 115, as by welding, and extending in upwardly spaced relation above the center lateral offset section 113, to aid in longitudinal stiffening of the adapter by engagement with the inner face of the vertical web portion of the side frame member 13*a*. A mirror image auxiliary mounting adapter bar may be provided for the opposite side rail assembly.

While the invention has been described with respect to various illustrative embodiments thereof, it will be apparent to those skilled in the art that various modifications and improvements may be made without departing from the scope and spirit of the invention. For instance, while the side rail assemblies according to the invention are most advantageously utilized in combination with independently suspended rigidifying cross bar assemblies as shown and described, and such is clearly an important inventive aspect, the side rail assemblies according to the invention may, though less advantageously, be utilized on bed frames having rigid pivot mounting elements such as tubes, or the like rigidly secured to the bed frame, it being appreciated that such arrangements will sacrifice the important feature of the preferred overall combination arrangement as shown and described, in which the rigidifying cross members do not form a rigid part of the supporting frame of the bed. Accordingly, it will be understood that the invention is not to be limited by the illustrated embodiments, but only by the scope of the appended claims.

I claim:

1. A bed arrangement comprising
a bed frame,
a side rail assembly for said bed frame, said side rail assembly comprising
a pair of separately detachable side rails each with spaced risers pivotally secured thereto, and one riser having a releasable pivot-prevention lock thereon,
said risers being removably pivotally mounted on said bed frame,
and a pair of nonpermanent and detachable cross members extending transversely across said bed frame and releasably engageable in pivotal interconnecting relation each with respective opposite pairs of said side rails risers,
said side rail risers each having pivot pins thereon,
and said cross members each having end openings for receiving said pivot pins,
said cross members being relatively pivotally engaged at their end openings with said riser pivot pins, and being supported in suspended relation between and by said pivot pins,
said bed frame including spaced generally parallel longitudinal side frame members with spaced holes effectively formed thereon,
said cross members extending between said side frame members and having their said end openings in effective alignment with respective opposite pairs of said holes,
said riser pivot pins extending through said holes and into said cross member end openings,
and releasable securing means releasably securing said pins within said side frame member holes.

2. A bed arrangement according to claim 1,
each of said releasable pivot-prevention locks on said risers including a latch removably pivotally engaged with a respective adjacent one of said longitudinal side frame members,
said latches each having a slot therein larger in one direction than the cross section of the respective said riser pivot pin, and through which slot a respective said riser pivot pin extends to enable pivoted lock/release movement of said latch about the zone of pivotal engagement of said latch with a respective said longitudinal side frame member,
and a lock pin on each of said risers which have a latch thereon and latchably engageable in riser-locking relation with said latch at one pivoted position of said latch and releasable from its riser locked relation at a second pivoted position of said latch.

3. A bed arrangement according to claim 2,
the pivotal engagement of said latches with said longitudinal side frame members being about a generally horizontal pivot axis, said one pivoted position of said latch being an upward pivoted position as compared to said second pivoted position of said latch, whereby said latch is gravity biased toward said one pivoted position.

4. A bed arrangement according to claim 3,
said releasable securing means comprising finger actuatable spring retainers carried by each of said risers and releasably engageable in resilient relation with said riser pivot pins.

5. A bed arrangement according to claim 4,
said finger actuatable spring retainers carried by said risers which have said latch attached thereto being anchored to the respective said latch and releasably engageable in spring biased locking relation with the respective adjacent said riser pivot pin.

6. A bed arrangement according to claim 5,
said finger actuatable spring retainers which are anchored to said latches being anchored each to its respective said latch in spaced relation from the respective said riser pivot pin and engaging the respective said riser pivot pin in cantilevered spring biasing relation toward a locked position with respect to said latchably engageable further pin on the respective said riser.

7. A bed arrangement according to claim 6,
a pivotal engagement of each of said latches with said longitudinal side frame members being about a respective generally horizontal pivot axis, said one pivoted position of each said latch being an upward pivoted position as compared to said second pivoted position of said latch, whereby said latch is gravity biased toward said one pivoted position.

8. A bed arrangement according to claim 6,
said riser pivot pins each having a groove therein for releasable retentive engagement by said spring retainers on the inner side of the respective said longitudinal side frame member.

9. A bed arrangement according to claim 8,
two of said spring retainers being each secured in latch-engaging relation to a respective one of said riser pivot pins and being also releasably engageable with a said groove in the respective said pivot pin at a position spaced along the length of said pin from said wrap-engaging relation position of said spring retainer on the respective said pin.

10. A bed arrangement according to claim 9,
each of said spring retainers having a finger engageable loop thereon for finger actuated locking or release thereof relative to its said riser pivot pin and the respective said longitudinal side frame member.

11. A bed arrangement according to claim 4,
two of said spring retainers being each secured in latch-engaging relation to a respective one of said riser pivot pins and being also releasably engageable with a said groove in the respective said pivot pin at a position spaced along the length of said pin from said wrap-engaging relation position of said spring retainer on the respective said pin.

12. A bed arrangement according to claim 11,
each of said spring retainers having a finger engageable loop thereon for finger actuated locking or release thereof relative to its said riser pivot pin and the respective said longitudinal side frame member.

13. A bed arrangement according to claim 1,
said releasable securing means comprising finger actuatable spring retainers carried by each of said risers and releasably engageable in resilient relation with said riser pivot pins.

14. A bed arrangement according to claim 13,
each of said spring retainers having a finger engageable loop thereon for finger actuated locking or release thereof relative to its said riser pivot pin and the respective said longitudinal side frame member.

15. A bed arrangement according to claim 13, said riser pivot pins each having a retention groove therein for releasable retentive engagement by said spring retainers on the inner side of the respective said longitudinal side frame member.

16. A bed arrangement according to claim 13, two of said spring retainers being each secured in latch-engaging relation to a respective one of said riser pivot pins and being also releasably engageable with a said retention groove in the respective said pivot pin at a position spaced along the length of said pin from said warp-engaging relation position of said spring retainer on the respective said pin.

17. A side rail assembly for a bed, for selective detachable connection to a bed, comprising a pair of separately detachable side rails each with spaced risers pivotally secured thereto, and one said riser having a releasable pivot-prevention lock thereon for selectively locking said riser in a given position about a pivot axis therefor, and a pair of nonpermanent and detachable cross members, extendable transversely across a bed frame and releasably separably engageable in pivotal interconnecting relation each with respective opposite ones of each of the two risers associated with each of said side rails, each of said releasable pivot prevention locks including a selectively movable latch, said latches each having a slot therein of larger vertical extent than the respective said riser pivot pin, and through which slot a respective said riser pivot pin extends, to enable support of said latch by said pivot pin when said side rail assembly is not connected to a bed and to enable up and down lock-/release movement of said latch when said latch is engaged with a bed, and a pivot-stop on each said riser which has a latch thereon and latchably engageable in locking relation with said latch at one pivoted position of said latch and releasable from its riser-locked relation at a second pivotal position of said latch.

18. A side rail assembly according to claim 17, each of said movable latches including a cam surface engageable in latch moving relation by the respective said riser stop pin as the respective said riser approaches one extent of its pivoted travel, and a slot adjacent to said cam surface and engageable in releasable locking engagement with said stop pin at said one extent to pivoted travel of the respective said one riser.

19. A bed arrangement comprising a bed frame, a side rail assembly for said bed frame, said side rail assembly comprising a pair of separately detachable side rails each with spaced risers pivotally secured thereto, said risers being removably pivotally mounted on an effective portion of said bed frame, and a pair of nonpermanent and detachable cross members extending transversely across said bed frame and releasably engageable in pivotal interconnecting relation each with respective opposite pairs of said side rail risers, said cross members and said side rail risers having a respective pin and socket interconnection formed therebetween at opposite end zones of said cross members, said cross members and said risers being relatively pivotally interconnectable through their respective said pin and socket interconnections, said bed frame including spaced generally parallel longitudinal side frame members with spaced holes effectively formed thereon, said cross members extending between said side frame members and said cross members and said risers being removably disposed with their respective pin and socket connections aligned with and having a portion thereof extending through spaced holes and supported on said side frame members, and releasable securing means releasably securing said pin and socket interconnections with a portion of said interconnections extending through said spaced side frame member holes.

20. A bed arrangement comprising a bed frame, a side rail assembly for said bed frame, said side rail assembly comprising a pair of separately detachable side rails each with spaced risers pivotally secured thereto, said risers being removably pivotally mounted on an effective portion of said bed frame, and a pair of nonpermanent and detachable cross members extending transversely across said bed frame and releasably engageable in pivotal interconnecting relation each with respective opposite pairs of said side rail risers, said side rail risers each having pivot pins thereon, and said cross members each having end openings for receiving said pivot pins, said cross members being relatively pivotally engaged at their end openings with said riser pivot pins, and being supported in suspended relation between and by said pivot pins, said bed frame including spaced generally parallel longitudinal side frame members with spaced holes effectively formed thereon, said cross members extending between said side frame members and having their said end openings in effective alignment with respective opposite pairs of said holes, said riser pivot pins extending through said holes and into said cross member end openings, and releasable securing means releasably securing said pins within said side frame member holes.

21. A bed arrangement comprising a bed frame, a side rail assembly for said bed frame, said side rail assembly comprising a pair of separately detachable side rails each with spaced risers pivotally secured thereto, and one riser having a releasable pivot-prevention lock thereon, said risers being removably pivotally mounted on said bed frame, and a pair of nonpermanent and manually releasably detachable lateral rigidifying stabilizers cross members extending transversely across said bed frame and releasably engageable in pivotal and lateral rigidifying interconnecting relation each with respective opposite pairs of said side rail risers, said side rail risers each having pivot pins thereon, and said detachable stabilizer cross members each having end openings for receiving said pivot pins, said cross members being relatively pivotally engaged at their end openings with said riser pivot pins, and being supported in suspended relation between and by said pivot pins, and releasable securing means releasably securing said pivot pins to said bed frame with said cross members extending therebetween, said releasable securing means comprising finger-actuatable spring retainers for each of said risers and releasably engageable in resilient relation with said riser pins, said releasable pivot-prevention lock on said riser including a latch removably pivotally engaged with a respective adjacent effective portion of one of said longitudinal side frame members, two of said spring retainers being each secured in latch-engaging relation to a respective one of said riser pivot pins and being also releasably engageable with a said groove in the respective said pivot pin at a position spaced along the length of said pin from said wrap-engaging relation position of said spring retainer on the respective said pin.

22. A bed arrangement according to claim 21, each of said spring retainers having a finger engageable loop thereon for finger actuated locking or release thereof relative to its said riser pivot pin and the respective said longitudinal side frame member.

23. A side rail assembly for selective detachable connection to a bed, having a bed frame including spaced generally parallel longitudinal side frame members with spaced holes effectively formed thereon, comprising a side rail assembly for a said bed frame, said side rail assembly comprising a pair of separately detachable side rails each with spaced risers pivotally secured thereto, said risers being removably pivotally mountable on an effective portion of a bed frame, and a pair of nonpermanent and detachable cross members extendable transversely across a said bed frame and releasably engageable in pivotal interconnecting relation each with respective opposite pairs of said side rail risers, said cross members and said side rail risers having a respective pin and socket interconnection formed therebetween at opposite end zones of said cross members, said cross members and said risers being relatively pivotally interconnectable through their respective said pin and socket interconnections, said cross members extending between said side frame members and said cross members and said risers being removably disposed with their respective pin and socket connections alignable with and having a portion thereof extendable through said spaced holes and supportable on said side frame members.

and releasable securing means for releasably securing said pin and socket interconnections with a portion of said interconnections extending through said spaced side frame member holes.

24. A side rail assembly for selective detachable connection to a bed, having a bed frame including spaced generally parallel longitudinal side frame members with spaced holes effectively formed thereon, comprising a side rail assembly for a said bed frame, said side rail assembly comprising a pair of separately detachable side rails each with spaced risers pivotally secured thereto, said risers removably pivotally mountable on an effective portion of a said bed frame, and a pair of nonpermanent and detachable cross members extendable transversely across a said bed frame and releasably engageable in pivotal interconnecting relation each with respective opposite pairs of said side rail risers, said side rail risers each having pivot pins thereon, and said cross members each having end openings for receiving said pivot pins, said cross members being relatively pivotally engaged at their end openings with said riser pivot pins, and being supportable in suspended relation between and by said pivot pins, said cross members extendable transversely between said side frame members and having their said end openings in effective alignment with respective opposite pairs of said holes, said riser pivot pins extendable through said holes and into said cross member end openings, and releasable securing means for releasably securing said pins within said side frame member holes.

* * * * *